US008490793B2

(12) United States Patent
Evenson et al.

(10) Patent No.: US 8,490,793 B2
(45) Date of Patent: Jul. 23, 2013

(54) OPENING FEATURE FOR PACKAGING HAVING ABSORBENT ARTICLES CONTAINED THEREIN

(75) Inventors: Stacy Evenson, Neenah, WI (US); David J. Schurr, Grosse Point Park, MI (US); Stephen Kehn, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/166,490

(22) Filed: Jun. 22, 2011

(65) Prior Publication Data

US 2012/0325716 A1 Dec. 27, 2012

(51) Int. Cl.
*B65D 85/16* (2006.01)
*B65D 65/28* (2006.01)

(52) U.S. Cl.
USPC ..... 206/494; 206/440; 383/207

(58) Field of Classification Search
USPC ..... 206/494, 440, 497, 581, 812; 383/207, 383/200, 205
See application file for complete search history.

(56) References Cited

U.S. PATENT DOCUMENTS

| | | | | | |
|---|---|---|---|---|---|
| 4,890,934 | A | * | 1/1990 | Feaver et al. | 383/10 |
| 4,934,535 | A | * | 6/1990 | Muckenfuhs et al. | 206/494 |
| 4,966,286 | A | * | 10/1990 | Muckenfuhs | 206/494 |
| 5,022,216 | A | * | 6/1991 | Muckenfuhs et al. | 53/438 |
| 5,036,978 | A | * | 8/1991 | Frank et al. | 206/494 |
| 5,050,742 | A | * | 9/1991 | Muckenfuhs | 206/494 |
| 5,054,619 | A | | 10/1991 | Muckenfuhs | |
| 5,065,868 | A | * | 11/1991 | Cornelissen et al. | 206/494 |
| 5,121,995 | A | | 6/1992 | Newman et al. | |
| 5,219,229 | A | | 6/1993 | Sengewald | |
| 5,282,687 | A | * | 2/1994 | Yee | 383/25 |
| 5,514,067 | A | * | 5/1996 | Schmidt et al. | 493/196 |
| 5,666,445 | A | * | 9/1997 | Conrad et al. | 383/207 |
| 5,722,773 | A | | 3/1998 | Conrad | |
| 5,934,470 | A | * | 8/1999 | Bauer et al. | 206/494 |
| 6,095,686 | A | | 8/2000 | Mohrmann | |

(Continued)

FOREIGN PATENT DOCUMENTS

| | | | |
|---|---|---|---|
| EP | 0585653 | A1 | 9/1994 |
| JP | 11091801 | A | 4/1999 |

(Continued)

OTHER PUBLICATIONS

International Search Report and Written Opinion for PCT/IB2012/052478 dated Nov. 23, 2012; 10 pages.

*Primary Examiner* — Steven A. Reynolds
(74) *Attorney, Agent, or Firm* — Armstrong Teasdale LLP

(57) ABSTRACT

A package includes a plurality of disposable absorbent articles and a packaging having a front panel, a back panel, a top panel, a bottom panel, and a pair of side panels. The panels cooperatively define an interior compartment. At least one of the side panels has a longitudinal central axis, a pair of side edges, a gusset disposed adjacent the top panel, and a line of weakness having a first portion disposed on one side of the longitudinal central axis, a second portion disposed on the opposite side of the longitudinal central axis, and a third portion spanning between and connecting the first and second portions. The third portion of the line of weakness is spaced from the ends of the first and second portions. The plurality of disposable absorbent articles is compressed within the interior compartment and arranged in at least one row extending between the side panels.

20 Claims, 13 Drawing Sheets

U.S. PATENT DOCUMENTS

| | | | | |
|---|---|---|---|---|
| 6,698,928 | B2 * | 3/2004 | Miller | 383/205 |
| 7,866,473 | B2 * | 1/2011 | Clark et al. | 206/494 |
| 2002/0112982 | A1 * | 8/2002 | Stagray et al. | 206/494 |
| 2006/0021894 | A1 * | 2/2006 | Clark et al. | 206/440 |
| 2009/0255847 | A1 | 10/2009 | Motsch et al. | |
| 2009/0257689 | A1 | 10/2009 | Motsch | |

FOREIGN PATENT DOCUMENTS

| | | | |
|---|---|---|---|
| JP | 11100045 | A | 4/1999 |
| WO | 9508491 | A1 | 3/1995 |
| WO | 2010062231 | A1 | 6/2010 |

* cited by examiner

OPENING FEATURE FOR PACKAGING HAVING ABSORBENT ARTICLES CONTAINED THEREIN

FIELD

The field of the invention relates generally to packaging for articles and, more particularly, to an opening feature for packaging having a plurality of compressed disposable absorbent articles contained therein.

BACKGROUND

It is known that disposable absorbent articles can be conveniently and efficiently packaged within flexible packaging, such as polyethylene. Often, the disposable absorbent articles are compressed within the flexible packaging to produce a smaller volume package as compared to an arrangement wherein the disposable absorbent articles are not compressed within the flexible packaging. Having the disposable absorbent articles in a compressed configuration or state within the packaging reduces material costs (i.e., the packaging can be smaller) and distribution costs (e.g., shipping, handling, and storage costs).

In addition, the compressed disposable absorbent articles hold the packaging in tension, which causes the surfaces of the packaging to be generally smooth. These generally smooth surfaces make for a more aesthetically pleasing package. Moreover, it is easier for consumers, wearers, and/or caregivers to view graphics and read writing printed on the smooth surfaces of the packaging.

Current compressed packages of disposable absorbent articles have at least a couple of drawbacks. For one, the opening feature may not be readily apparent and therefore the consumer may not be able to easily find the opening feature. Secondly, since the compressed disposable absorbent articles apply a force against the packaging, the opening feature needs to be strong enough to withstand at least this force. Otherwise, the packaging would be prone to tearing open during shipping and handling of the package. As a result, the opening features are sometimes difficult for the user of the package to use. Moreover, it can be difficult for the user to remove the first few disposable absorbent articles from the package as a result of the absorbent articles being held in the compressed configuration by the packaging. This is especially true if the user is geriatric or suffers from a medical condition (e.g., arthritis).

Therefore, there is a need for a package with an opening feature that is relatively easy to use while being able to withstand the forces applied thereto by a plurality of compressed disposable absorbent articles contained therein. There is also a need for an opening feature for packaging that allows the user to relatively easily remove the first few absorbent articles from the packaging.

SUMMARY

In one aspect, a package generally comprises a plurality of disposable absorbent articles and a packaging. The packaging has a front panel, a back panel, a top panel, a bottom panel, and a pair of side panels. The panels cooperatively define an interior compartment of the packaging. At least one of the side panels has a longitudinal central axis, a pair of side edges, a gusset disposed adjacent the top panel, and a line of weakness having a first portion disposed on one side of the longitudinal central axis, a second portion disposed on the opposite side of the longitudinal central axis, and a third portion spanning between and connecting the first and second portions. The third portion of the line of weakness is spaced from the ends of the first and second portions. Each of the portions of the line of weakness extends through the gusset. The plurality of disposable absorbent articles is compressed within the interior compartment of the packaging and arranged in at least one row extending between the side panels.

In another aspect, a package generally comprises a plurality of disposable absorbent articles and a packaging. The packaging has a front panel, a back panel, a top panel, a bottom panel, and a pair of side panels. The panels cooperatively define an interior compartment of the packaging. At least one of the panels has an opening feature configured to move the package from a closed, sealed configuration to an opened configuration when at least a threshold force is applied to the opening feature. The plurality of disposable absorbent articles is compressed within the interior compartment of the packaging and arranged in at least one row extending between the side panels. The threshold force is between about 1 pound and about 20 pounds.

In yet another aspect, a package generally comprises a plurality of disposable absorbent articles and a packaging. The packaging has a front panel, a back panel, a top panel, a bottom panel, and a pair of side panels. The panels cooperatively define an interior compartment of the packaging. The plurality of disposable absorbent articles is compressed within the interior compartment. At least one of the side panels has an opening feature including a gusset and a line of weakness that extends through and is operatively connected to the gusset. The gusset has an upper edge, an inner panel, and an outer panel. The inner and outer panels define a pocket. The line of weakness comprises a first portion, a second portion, and a third portion that spans between and connects the first and second portions. The third portion of the line of weakness is located at least in part on the inner panel and spaced from the upper edge of the gusset.

BRIEF DESCRIPTION OF THE DRAWINGS

Corresponding reference characters indicate corresponding parts throughout the drawings.

DETAILED DESCRIPTION OF THE DRAWINGS

Figure 1:
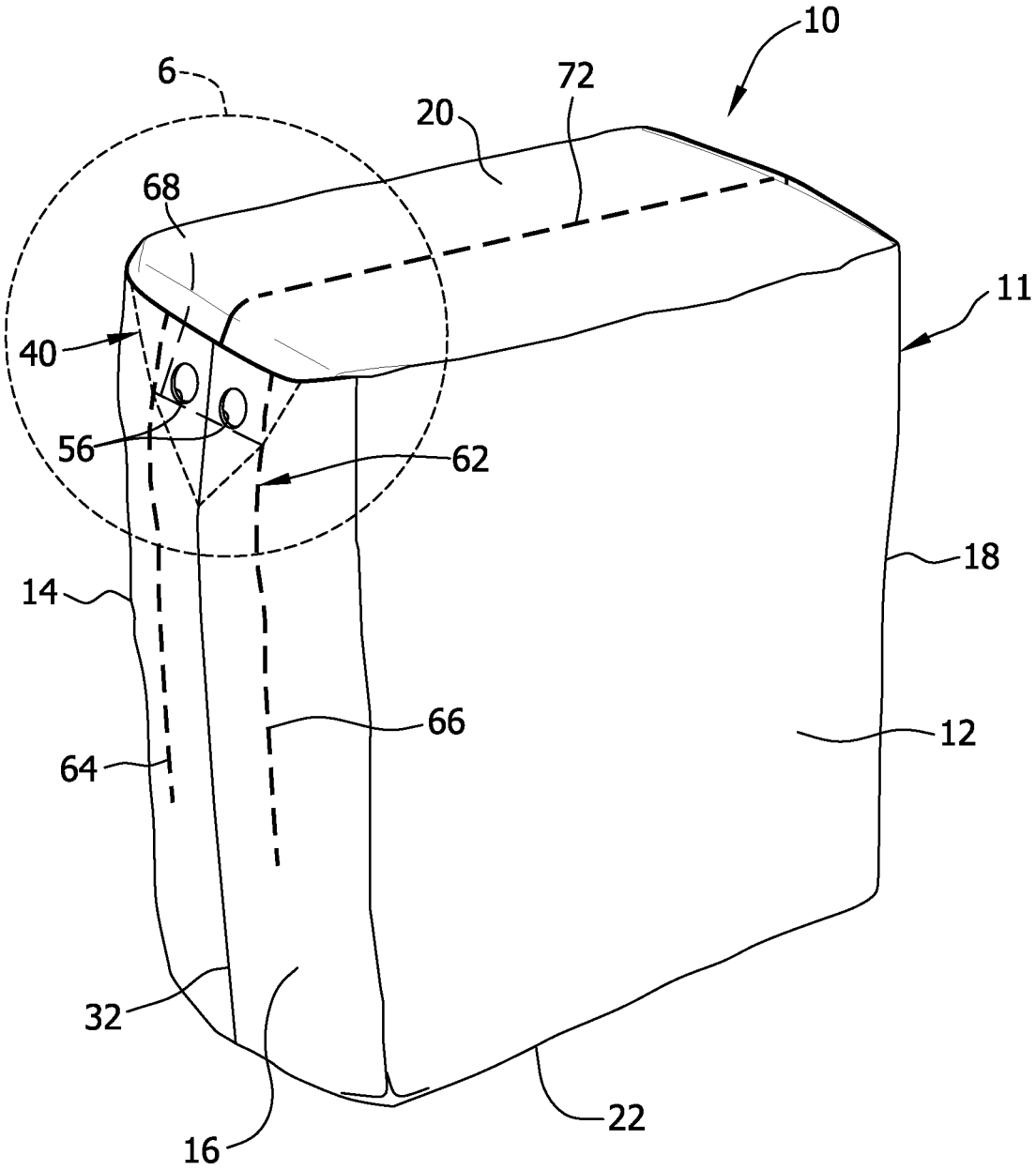
FIG. 1 is a perspective of a package comprising a flexible packaging and a plurality of compressed disposable absorbent articles contained within the packaging, the packaging having one embodiment of an opening feature.

Referring now to the drawings, FIGS. 1-8 illustrate one embodiment of a compressed package, indicated generally at 10, comprising flexible packaging, indicated at 11, and a plurality of disposable absorbent articles, indicated at 26, received within the packaging in a compressed configuration. By "compressed package" it is meant a package that contains a plurality of articles wherein the plurality of articles have a pre-insertion dimension, measured along at least one axis, which is greater in length than when the plurality of articles are contained in the packaging. For example, if fourteen articles are assembled into a row having a pre-insertion dimension, measured along an axis, e.g., the x axis, of 10 inches (254 mm) and the row of articles are then compressed by a force of at least 1 pound to a dimension of less than 10 inches (254 mm) when they are contained in the packaging, then the articles are considered to be contained in a compressed package.

Figure 2:
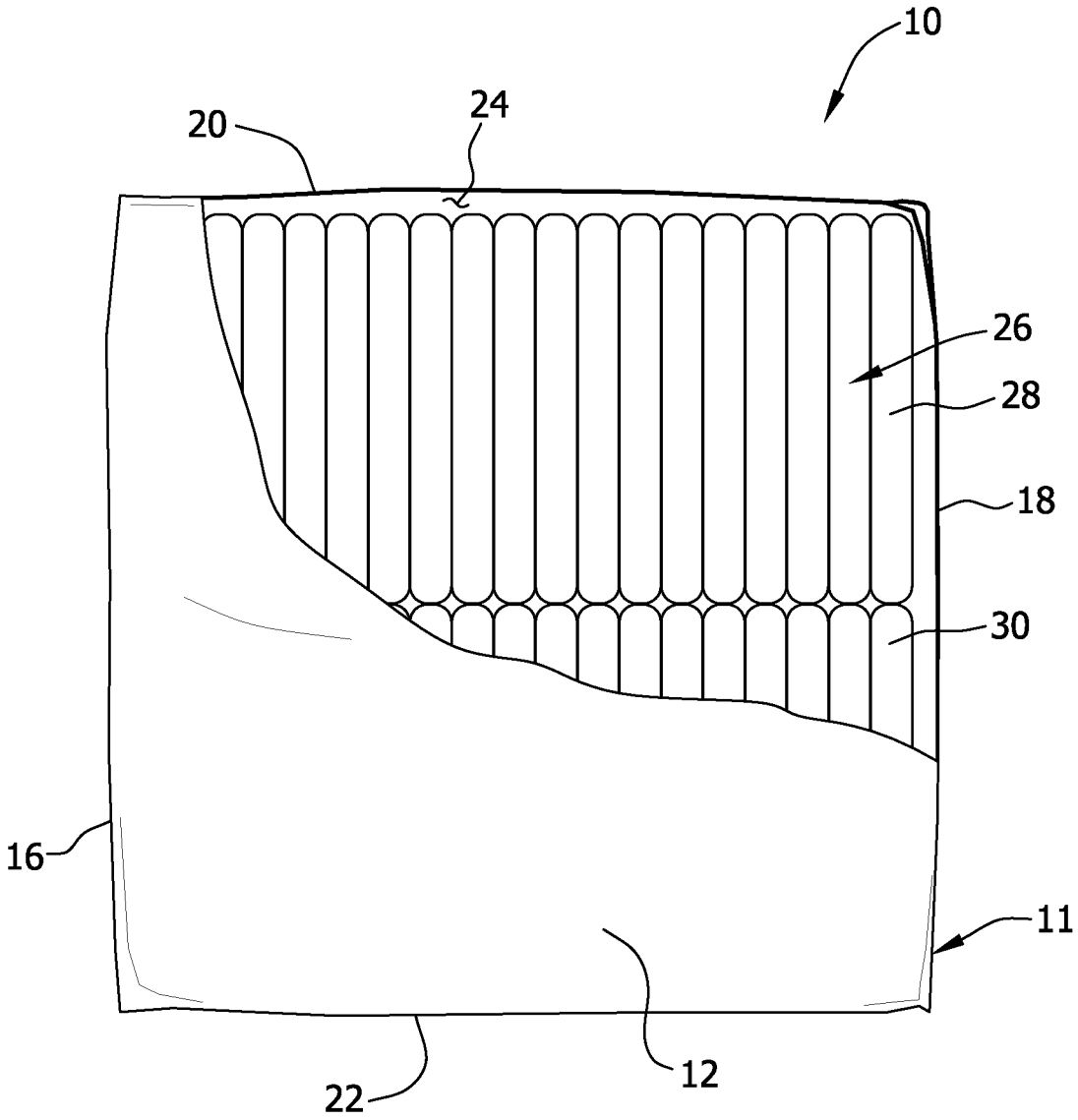
FIG. 2 is a front view of the package of FIG. 1 with portions cut away to show the plurality of disposable absorbent articles contained within the packaging.

As seen in FIG. 1, the illustrated packaging 11 has a front panel 12, a back panel 14, a first side panel 16, a second side panel 18, a top panel 20, and a bottom panel 22. The packaging 11 defines an internal compartment 24 sized and shaped to receive the plurality of articles 26 (FIG. 2). In the illustrated embodiment, the package 10 has a generally cuboid shape but it is understood that the package can have any suitable shape (e.g., a cube).

With reference to FIG. 2, the illustrated disposable absorbent articles 26 are adult incontinence garments but it is understood that other suitable disposable absorbent articles besides incontinence garments can be contained within the packaging 11. Examples of other suitable disposable absorbent articles 26 include, but are not limited to, infant diapers, training pants, absorbent swim pants, sanitary napkins, pantyliners, and feminine pads. As used herein, a disposable absorbent article is a product that is designed for a single use before it is discarded (i.e., not intended to be laundered and reused) and is constructed to absorb human exudates, such as urine, menses, and/or fecal matter.

In one suitable configuration, the disposable absorbent articles 26 are arranged in one or more rows 28, 30 within the internal compartment 24 of the package 10 with each row being formed by a plurality of aligned articles. In one suitable arrangement, there are from about 5 to about 100 disposable absorbent articles in each of the rows 28, 30. More suitably, there are from about 10 to about 50 disposable absorbent articles in a given row. In the illustrated embodiment, for example, each of the rows 28, 30 contains about 20 disposable absorbent articles. It is understood, however, that the number of articles 26 in each row 28, 30 can differ.

As seen in FIG. 2, the disposable absorbent articles 26 of the illustrated package 10 are arranged in two horizontal rows wherein one row 28 (i.e., an upper row) is located above the other row 30 (i.e., a lower row). It is contemplated, however, that the rows 28, 30 could be arranged in side-by-side relationship. It is further contemplated that the internal compartment 24 of the packaging 11 can contain more than two rows of articles. In such a configuration, the rows 28, 30 of articles 26 can be stacked, arranged in side-by-side relationship, or both. For example, the package 10 can contain two or more rows of articles 26 arranged in side-by-side relationship adjacent the bottom panel 22 of the packaging 11 and two or more rows arranged in side-by-side relationship above the lower rows and adjacent the top panel 20.

The illustrated disposable absorbent articles 26 are capable of being compressed. Suitably, each of the articles 26 can be compressed by a percentage between about 10 percent and about 50 percent. As a result, the volume of the internal compartment 24 of the packaging 11 can be reduced by a percentage between about 10 percent and 50 percent when compared to an arrangement wherein the disposable absorbent articles 26 are placed in the packaging 11 in an uncompressed configuration.

In one suitable embodiment, the articles 26 are compressed and are then inserted into the packaging 11. After the articles 26 are placed in the packaging 11, the packaging is sealed. The compressed articles 26 try to expand from their compressed configuration to an uncompressed configuration within the sealed packaging 11. The cumulative expansion efforts of the articles 26 place the packaging 11 under tension, which causes at least some of and, more suitably, all of the panels 12, 14, 16, 18, 20, 22 to become generally taut.

Suitably, the compressed disposable absorbent articles 26 apply between about 1 pound and about 20 pounds of force against the packaging 11 (i.e., an in-bag force), and more suitably between about 7 pounds and about 12 pounds. In one suitable embodiment, the compressed absorbent articles 26 apply about 9 pounds of force against the packaging 11. Since the illustrated articles 26 are arranged in horizontal rows 28, 30, the majority of the force from the compressed articles trying to expand is applied to the first and second side panels 16, 18. It is contemplated, however, that the articles 26 can be arranged in other suitable configurations so that the majority of the force is applied to other panels (e.g., the top and bottom panels 20, 22) of the packaging 11. It is understood that the force applied to the first and second side panels 16, 18 by the compressed articles 26 trying to expand may decrease over time. That is, the in-bag force caused by the compressed articles 26 may attenuate over time. One potential cause of this attenuation is the stretching of the flexible packaging 11.

Figure 3:
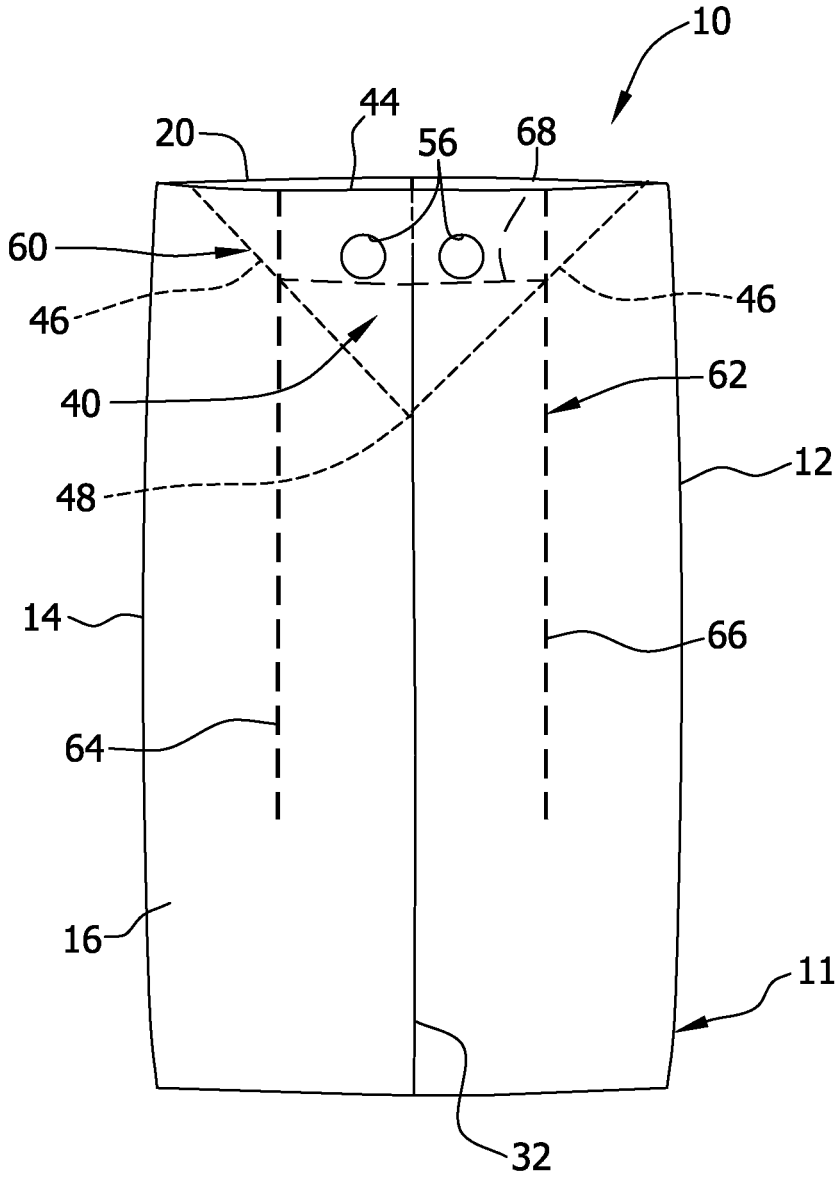
FIG. 3 is a side view of the package illustrating a first side panel of the packaging having the opening feature disposed thereon.
Figure 4:
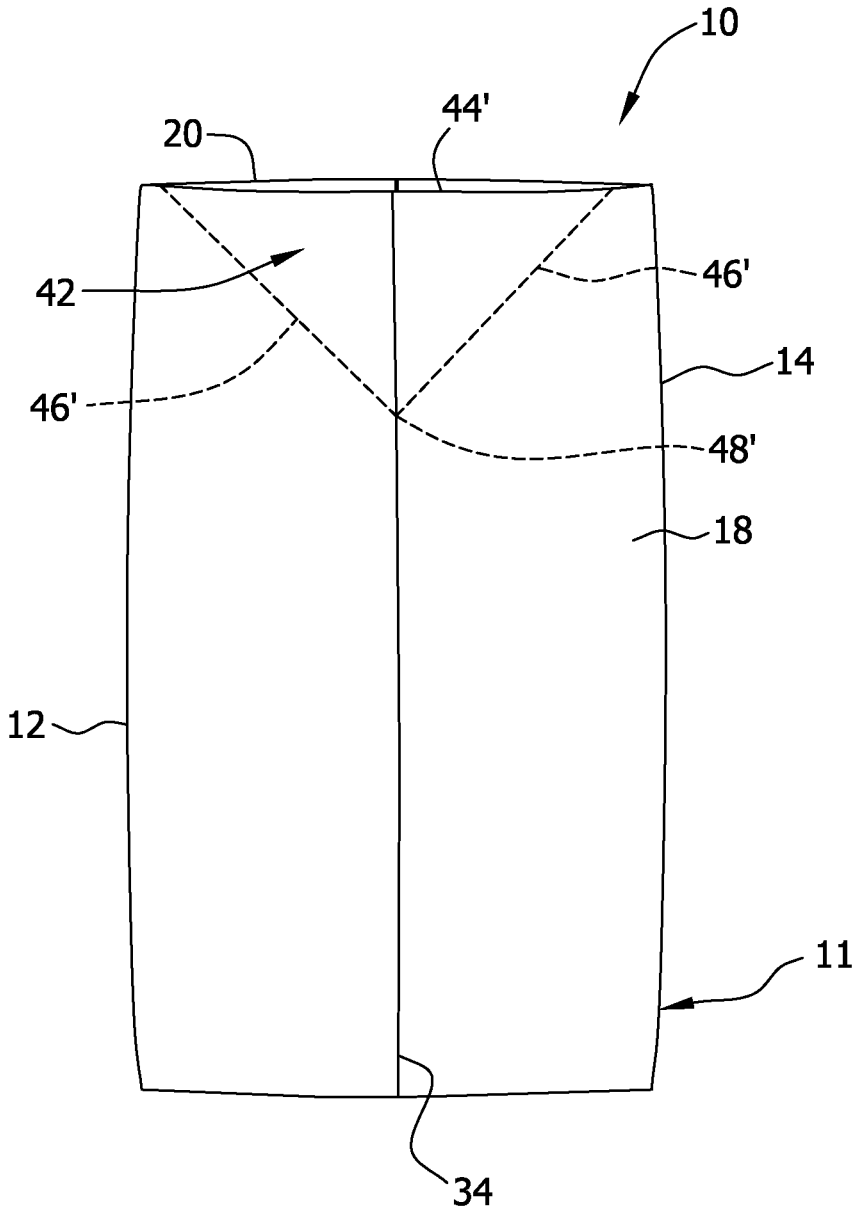
FIG. 4 is a side view of the package illustrating a second side panel of the packaging.

With reference now to FIGS. 3 and 4, the illustrated packaging 11 includes a pair of seams 32, 34. One of the seams 32 is disposed on the first side panel 16 and the other seam 34 is disposed on the second side panel 18. Each of the illustrated seams 32, 34 are generally aligned with (i.e., coaxial) the longitudinal central axis of the respective side panel 16, 18. It is contemplated that the seams 32, 34 can be offset with respect to the respective longitudinal central axis of the side panel. It is also contemplated that the seams 32, 34 can be disposed on other panels of the packaging 11 or can be omitted.

Figure 5:
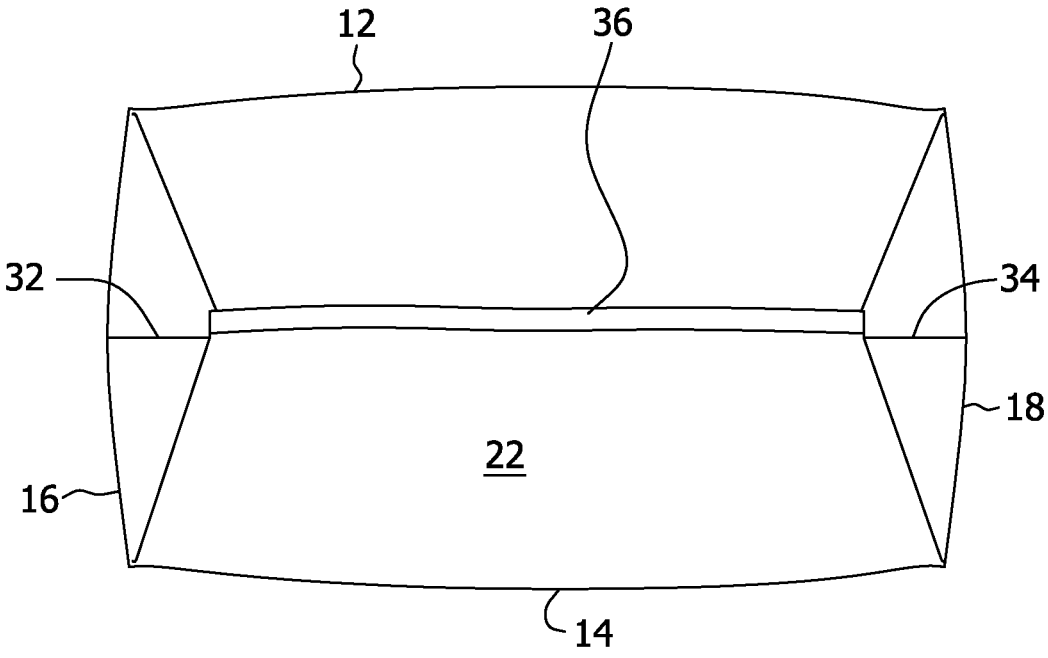
FIG. 5 is a bottom view of the package illustrating a bottom panel of the packaging.

As seen in FIG. 5, both of the seams 32, 34 extend from the respective side panel 16, 18 and across a portion of the bottom panel 22. The distance that each of the seams 32, 34 extends across a portion of the bottom panel 22 can vary. The seams 32, 34 can be formed by a heat and pressure bond, by a thermal bond, by an ultrasonic bond, by adhesive or by another means known to those skilled in the art.

With reference still to FIG. 5, a bottom seal 36 is formed in the bottom panel 22 of the packaging 11 after the plurality of articles 26 are placed into the internal compartment 24. As mentioned above, the disposable absorbent articles 26 are compressed before being placed within the internal compartment 24 of the packaging 11. Once the compressed articles 26 are placed within the packaging 11, the bottom panel 22 is sealed at the bottom seal 36 to enclose the plurality of articles within the packaging.

Figure 6:
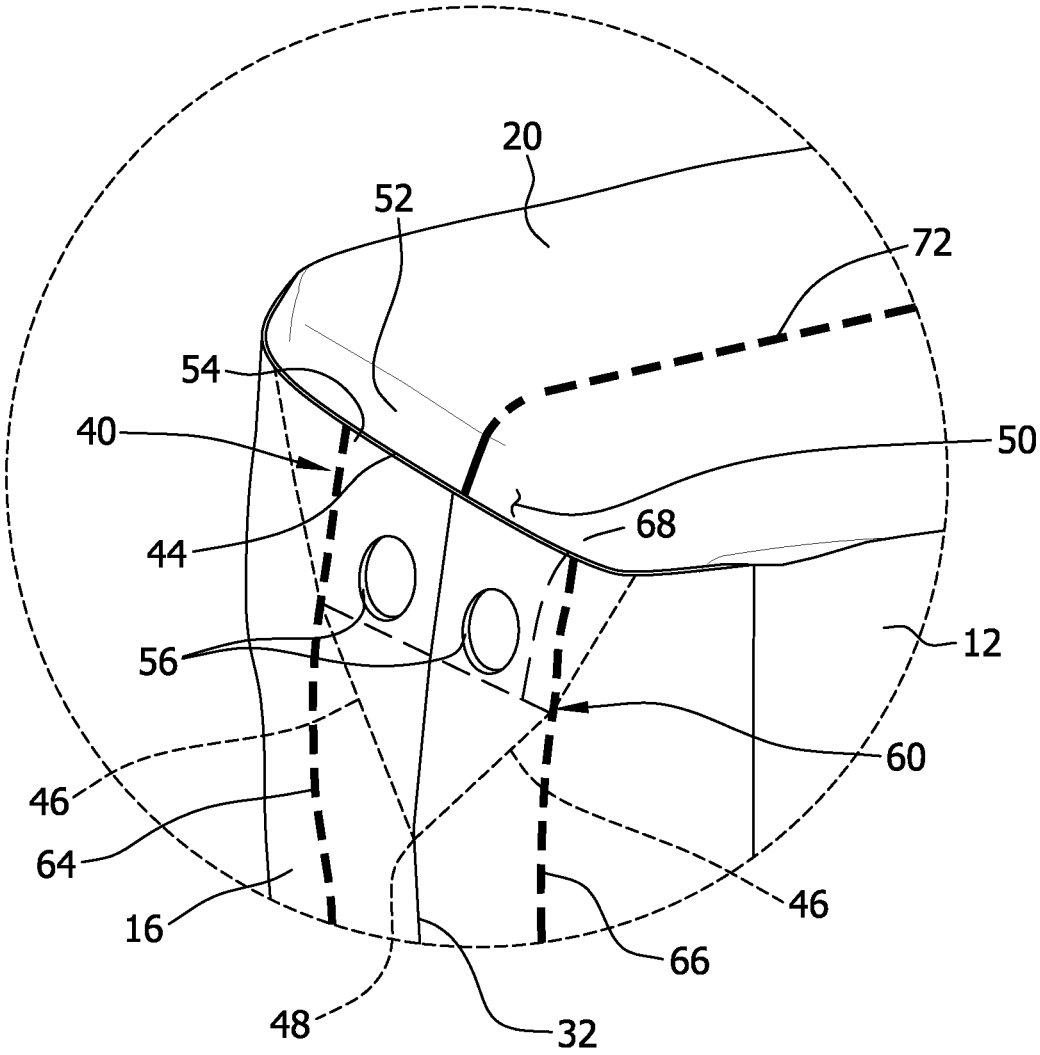
FIG. 6 is an enlarged perspective of the portion of the package circled in FIG. 1.

As illustrated in FIGS. 1 and 6, the packaging 11 has a gusset, indicated at 40, disposed on the first side panel 16 adjacent the top panel 20. Suitable, the packaging 11 includes a pair of gussets—the gusset 40 disposed on the first side panel 16 and another gusset, indicated at 42, disposed on the second side panel 18 (FIG. 4). In the illustrated embodiment, the gussets 40, 42 are integrally formed (i.e., formed as one-piece with) the other portions of the packaging 11 (i.e., all six panels 12, 14, 16, 18, 20, 22). In fact, the entire illustrated packaging 11 is formed from a single-piece of material. It is contemplated, however, that the gussets 40, 42 and/or any of the panels 12, 14, 16, 18, 20, 22 can be formed from separate pieces of material and attached to the other portions of the packaging 11.

In one suitable embodiment, the gussets 40, 42 are located on the respective side panel 16, 18 at a location adjacent the top panel 20 of the package 10. It is understood, however, that in other embodiments, the gussets 40, 42 can be located adjacent the bottom panel 22 or be disposed at a location between and spaced from the top and bottom panels 20, 22. It is also understood, that the gussets 40, 42 can be located on the top or bottom panels 20, 22 instead of the side panels 16, 18.

With reference again to FIGS. 3 and 4, each of the illustrated gussets 40, 42 has a generally triangular configuration. Accordingly, each of the gussets 40, 42 have three edges. More specifically, each of the gussets 40, 42 have an upper edge 44, 44' that is generally aligned with the top panel 20 (i.e., generally lies in the same plane as the top panel), and two edges 46, 46' that extend diagonally downward from the upper edge and converge to a point 48, 48'. In the illustrated embodiment, the points 48, 48' are located along the respective seam 32, 34. It is understood that the gussets 40, 42 can be formed in any suitable shapes.

At least the gusset 40 on the first side panel 16 is arranged to form a pocket 50 defined by an inner panel 52 and an outer panel 54 (FIG. 6). In the illustrated embodiment, the gusset 42 on the second side panel 18 is also arranged to form a pocket but it is contemplated that the gusset on the second side panel can be free of the gusset.

With reference still to FIG. 6, the pocket 50 in the gusset 40 on the first side panel 16 provides an enlarged area whereby the package user can position one or more of his/her fingers (e.g., two fingers) so as to easily grip and open the package 10. In the illustrated embodiment, a pair of finger apertures 56 is formed through the outer panel 54 of at least one of the pockets 50. Each of the finger apertures 56 is shaped and sized to receive at least one human finger therein. Thus, the outer panel 54 of the gusset 40 forms a gripping member for allowing the user of the package 10 to manually grasp the gusset. It is contemplated that the finger apertures 56 can be omitted or have different configurations (e.g., square, rectangular, oval, slits, cross, half moon). It is also contemplated that the packaging 11 can include indicia associated with the pocket 50 and/or finger apertures 56 to draw the user's attention thereto.

An opening feature, indicated generally at 60, of the packaging 11 includes the gusset 40 and a line of weakness, indicated at 62, that extends through and is operatively connected to the gusset. The opening feature 60 facilitates the user opening the packaging 11 and gaining access to the plurality of disposable absorbent articles 26 contained therein. In the illustrated embodiment, the opening feature 60 is formed only on the first side panel 16. In other words, the second side panel 18 of the illustrated packaging 11 is free of an opening feature. It is understood, however, that both of the side panels 16, 18 can be formed with opening features 60. When opening features 60 are formed on both of the side panels 16, 18, the packaging 11 can be easily opened from either side of the package 10.

In the illustrated embodiment, the line of weakness 62 includes a first portion 64, a second portion 66, and a third portion 68 that connects the first and second portions. As seen in FIG. 3, the first and second portions 64, 66 extend longitudinally along the first side panel 16 from the upper edge 44 of the gusset 40 to a location spaced from the upper edge. In the illustrated embodiment, the first and second portions 64, 66 extend about 75 percent of the length of the first side panel 16. It is contemplated that the first and second portions 64, 66 can extend along any suitable length of the first side panel 16. For example, the first and second portions 64, 66 can suitably extend between about 30 percent and about 90 percent, and more suitably, between about 50 percent and about 80 percent of the length of the first side panel 16.

As illustrated in FIG. 3, the first and second portions 64, 66 of the line of weakness 62 are spaced on opposite sides of the seam 32, which generally runs along the longitudinal central axis of the first side panel 16. In the illustrated embodiment, for example, each of the first and second portions 64, 66 are located approximately halfway between the seam 32 and the respective side edge of the first side panel 16. Suitably, each of the first and second portions 64, 66 are spaced outward from the seam a distance between approximately 2 percent and approximately 100 percent the distance from the seam to the respective side edge of the first side panel 16. In another suitable embodiment, the first and second portions 64, 66 are spaced outward from the seam a distance of approximately 3 millimeters or greater. In an embodiment having the first and second portions 64, 66 spaced outward from the seam a distance of approximately 3 millimeters, the distance between the first and second portions would be approximately 6 millimeters.

Figure 9:
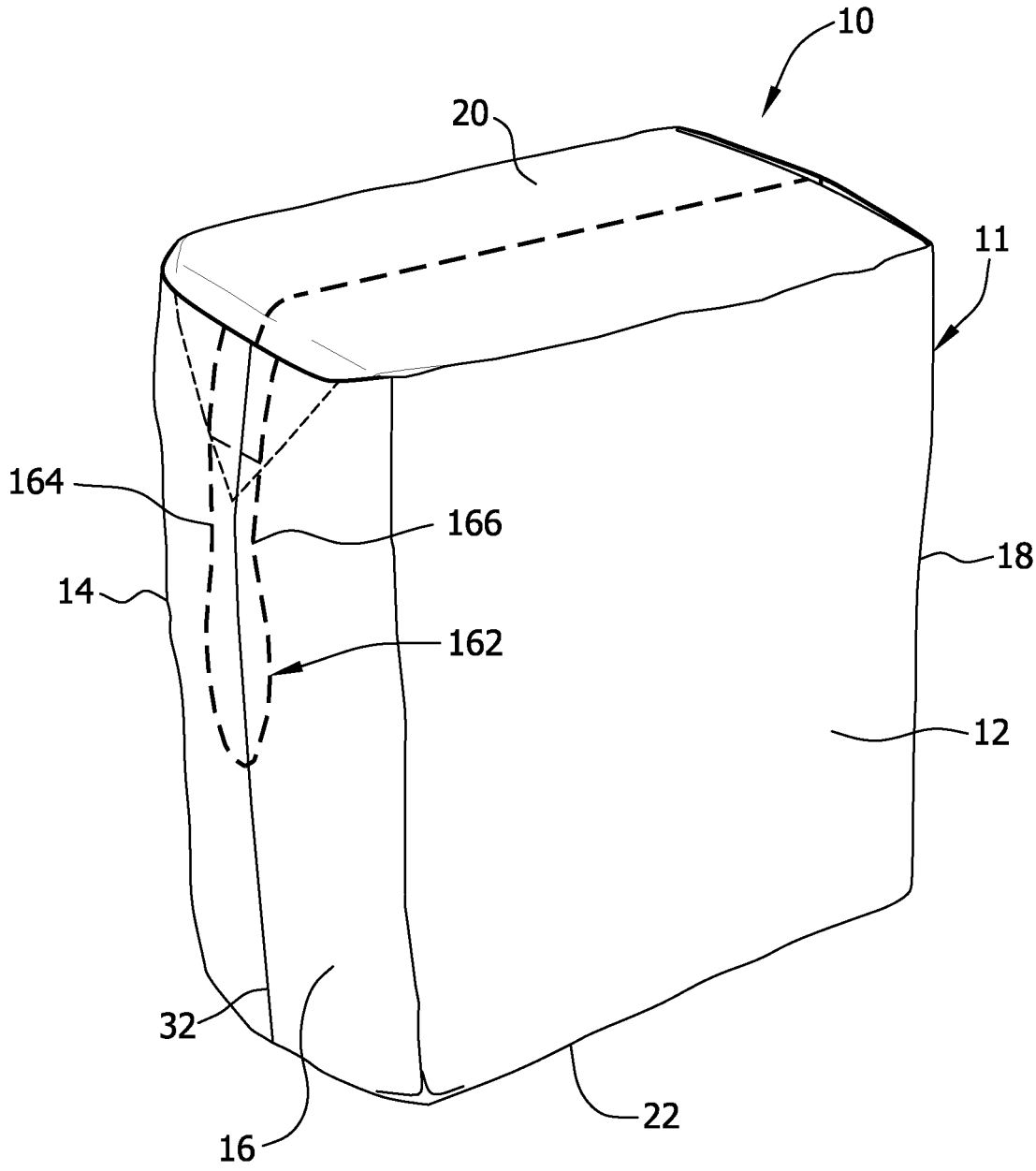
FIG. 9 is a perspective of the package wherein the first side panel of the packaging has another embodiment of an opening feature disposed thereon.
Figure 10:
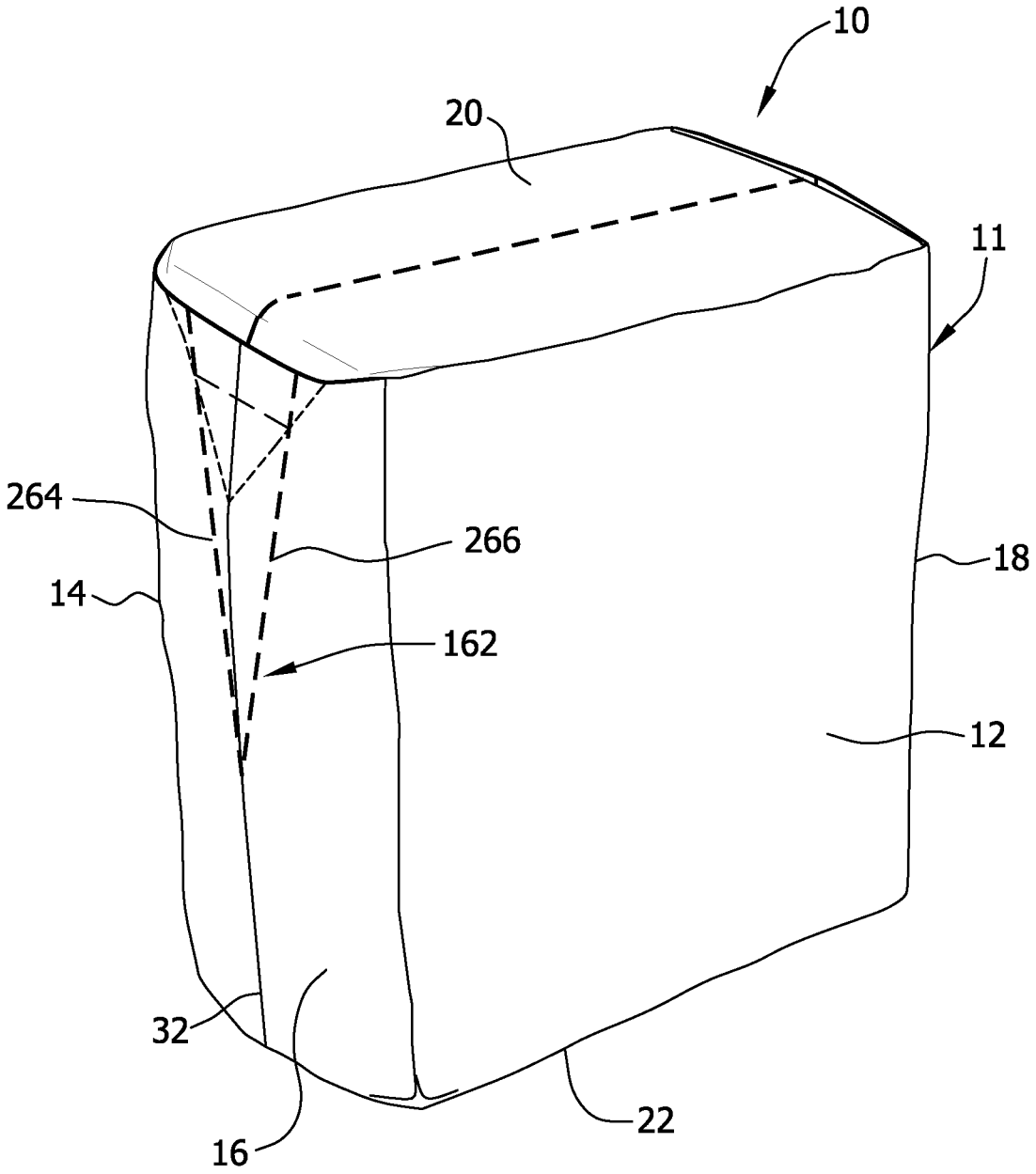
FIG. 10 is a perspective of the package wherein the first side panel of the packaging has yet another embodiment of an opening feature disposed thereon.

As seen in FIG. 6, the first and second portions 64, 66 of the line of weakness 62 extend generally parallel to one another and parallel to the seam 32. It is understood, however, that the first and second portions 64, 66 can be non-parallel to each other and/or the seam 32. For example, FIG. 9 illustrates an embodiment of the package 10 wherein the packaging 11 has first and second portions 164, 166 of a line of weakness 162 that are non-parallel to each other and the seam 32. In this embodiment, the first and second portions 164, 166 are non-linear (i.e., not straight) and are generally mirror images of each other. In another example, FIG. 10 illustrates an embodiment of the package 10 wherein the packaging 11 has first and second portions 264, 266 of a line of weakness 262 that are also non-parallel to each other and the seam 32. In this embodiment, the first and second portions 264, 266 are linear but converge to or otherwise intersect at a common point. It is also understood that the first and second portions can be different from each other in shape and length, if desired.

With reference again to FIG. 6, the third portion 68 of the line of weakness 62 is located within the pocket 50 formed by the inner and outer panels 52, 54 of the gusset 40, and extends between and operatively connects the first and second portions 64, 66, which extend through the outer panel of the gusset. As seen in FIG. 6, the part of the third portion 68 located on the inner panel 52 of the gusset 40 is spaced downward from the upper edge 44 of the gusset and thus, spaced downward from the top panel 20. In one suitable embodiment, the third portion 68 is disposed below the finger apertures 56. It is contemplated, however, that the relative position of the third portion 68 with respect to the finger apertures 56 can be different.

The line of weakness 62 and thus, each of its three portions 58, 60 and 62 can be a perforated line (as illustrated in accompanying Figures), a line formed by a plurality of openings, such as slots separated by a plurality of land areas, a line of reduced material thickness, a weakened line formed by joining two sections of material together, or any other suitable configuration or combination of configurations. It is contemplated that the line of weakness 62 or portions thereof can include indicia to draw the user's attention thereto.

The opening feature 60 of the illustrated embodiment is configured to move the package 10 from a closed, sealed configuration to an open configuration when a sufficient amount of force (i.e., a threshold force) is applied thereto. That is, the opening feature 60 can be used to move the package 10 from the closed configuration to the opened configuration when the threshold force is met or exceeded. Suitably, the threshold force for activating the opening feature 60 is between about 1 pound and about 20 pounds and, more suitably, between about 2 pounds and about 10 pounds, and even more suitably, between about 4 pounds and about 7 pounds. For example, in one suitable embodiment of the package 10, the opening feature 60 has a threshold force of about 6 pounds.

The opening feature 60 is configured to inhibit activation or movement during ordinary handling of the package 10 while having a relatively low threshold so that the opening feature is easy for the user to use. In one particularly suitable embodiment, the threshold force to move the opening feature 60 is less than the force applied to the packaging 11 by the plurality of compressed disposable absorbent articles 26. As mentioned above, the compressed absorbent articles 26 apply between about 7 pounds and about 12 pounds of force against the packaging 11, and more suitably about 9 pounds of force against the packaging. Thus, in the embodiment of the package 10 having about 9 pounds of force applied by the compressed absorbent articles 26 against the packaging 11, the threshold for activating the opening feature 60 can suitably be less than 9 pounds (e.g., 8 pounds). It is contemplated that in other embodiments, the threshold to activate the opening feature 60 can be generally equal to or greater than the force applied to the packaging 11 by the plurality of compressed disposable absorbent articles 26.

In one suitable embodiment, the packaging 11 can be formed from a polymeric material, such as polyethylene, polypropylene or a blend thereof. One suitable material for the packaging 11 is a polymeric film. Suitably, the polymeric film has a thickness of less than about 5 mils, more suitably, less than about 3 mils, and even more suitably, less than about 1.5 mils. The film can be a monolayer, multilayer coextruded, or a laminate structure. Other natural and synthetic materials, known to those skilled in the art, could also be used to make the package 10. Such other materials include, but are not limited to, woven and non-woven materials.

In one suitable method of opening the package 10, the user places one of his/her hands firmly on the top panel 20 of the packaging 11 to hold the package in place. Next, the user manually grasps the outer panel 54 of the gusset 40 with the other hand and inserts one of his/her fingers into each of the finger apertures 56. The user then pulls downward or downward and outward on the outer panel 54. This action causes the first and second portions 64, 66 of the line of weakness 62 to start to tear or break the outer panel 54 of the gusset 40.

Figure 7:
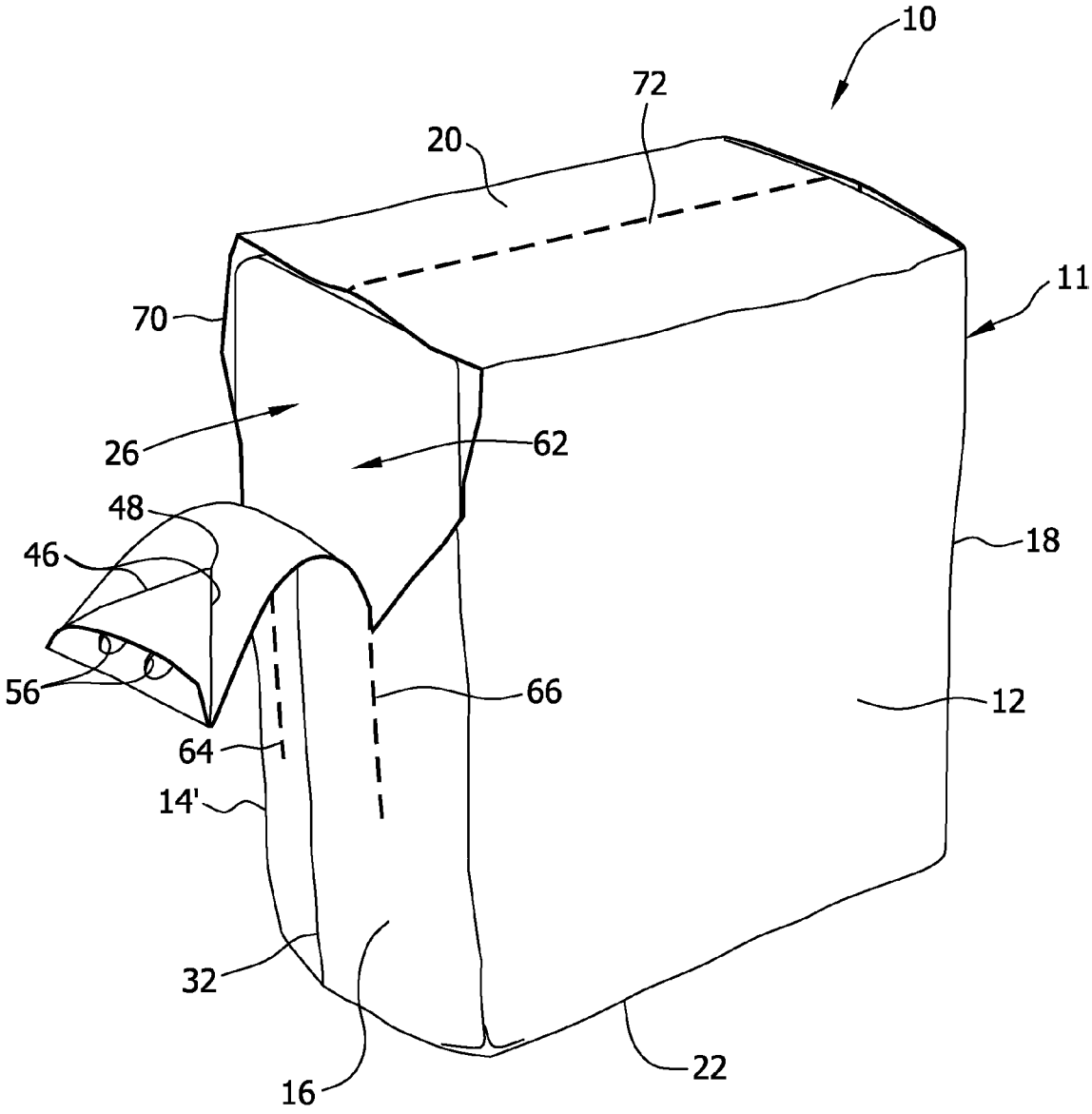
FIG. 7 is a perspective of the package of FIG. 1 showing the opening feature being used to move the package from a closed configuration to an opened configuration.
Figure 8:
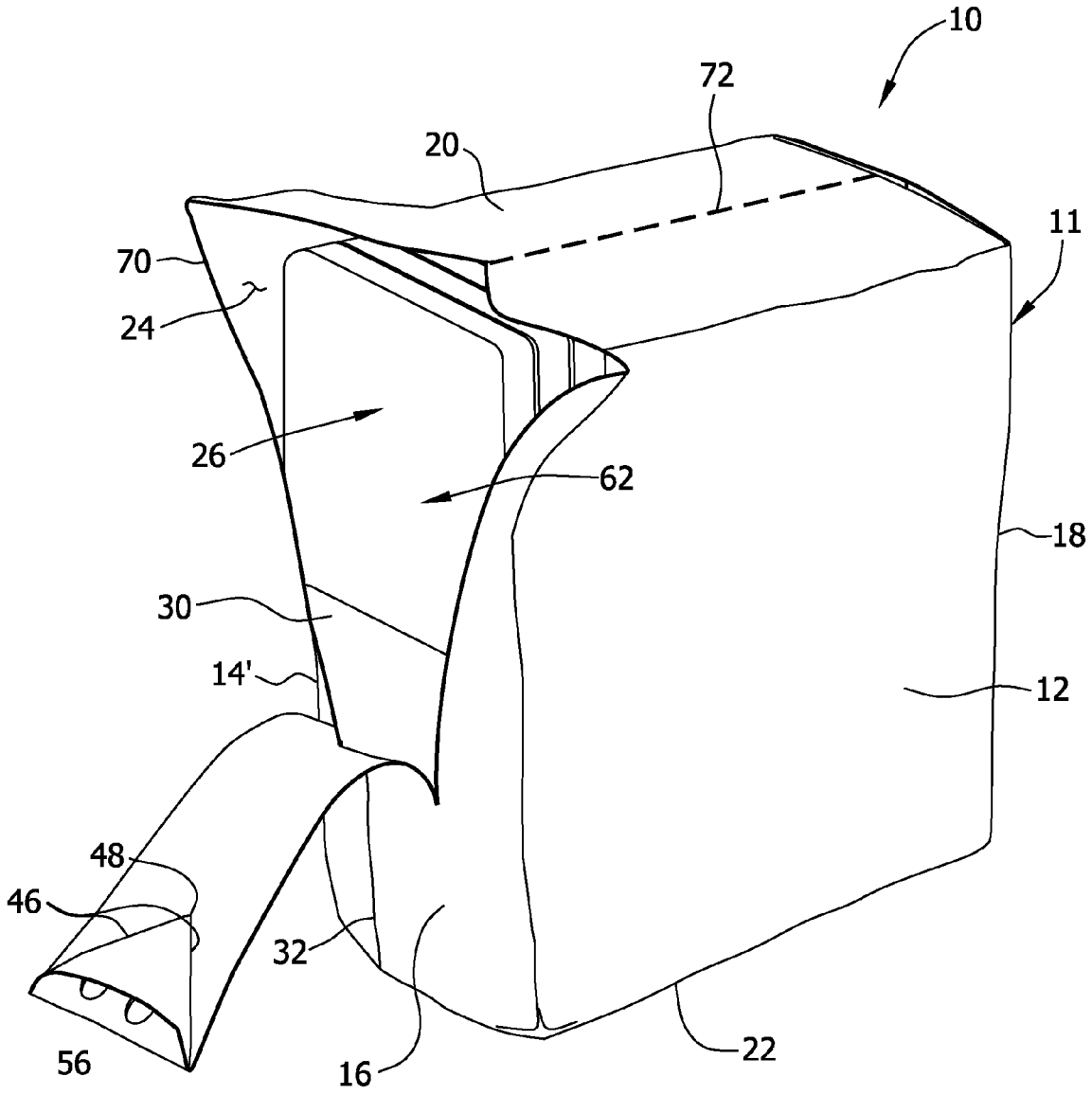
FIG. 8 is a perspective similar to FIG. 7 but illustrating the package in the opened configuration.

The user continues to pull downward or downward and outward on the outer panel 54 causing the first, second, and third portions 64, 66, 68 of the line of weakness 62 to tear open the first side panel 16 thereby moving the package toward its opened configuration. In FIG. 7, for example, the third portion 68 of the line of weakness has been fully torn while the first and second portions 64, 66 have been partially torn along their respective lengths. FIG. 8 illustrates the first and second portions 64, 66 being torn along their entire lengths.

As seen in FIGS. 7 and 8, the portion of the inner panel 52 of the gusset 40 disposed above the third portion 68 of the line of weakness moves upward to a position generally in plane with the top panel 20 of the packaging. The portions of the first side panel 16 disposed adjacent the gusset 40 moves outward to a position generally in plane with a respective one of the front and back panels 12, 14. As a result, an opening 70 that is large enough to release some of the force caused by the compressed articles 26 is formed. In one suitable embodiment, between about 25 percent and about 75 percent of the force caused by the compressed articles is released and, more suitable, about 50 percent of the force caused by the compressed articles is released.

With the package 10 in its opened configuration (FIG. 8), the user can easily remove the outermost absorbent article 26 from the packaging 11. In one suitable embodiment, less than 7 pounds of force (e.g., 5 pounds of force) is need to remove the first absorbent article of the plurality of disposable absorbent articles 26 from the packaging 11. It is understood, however, that the force need to remove the first absorbent article can be different with different levels of compression.

In illustrated embodiment, the packaging 11 further includes a line of weakness 72 extending longitudinally across the full length of the top panel 20. This line of weakness 72 can be selectively torn or partially torn by the user to provide even a larger opening in the packaging 11. Such a configuration provides easier access to the articles 26 located remote from the opening 70 in the first side panel 16. It is understood, that the line of weakness 72 can extend less than the entire length of the top panel 20, be located off center, and/or be non-linear. It is further contemplated that the line of weakness 72 on the top panel 20 can be omitted.

Figure 11:
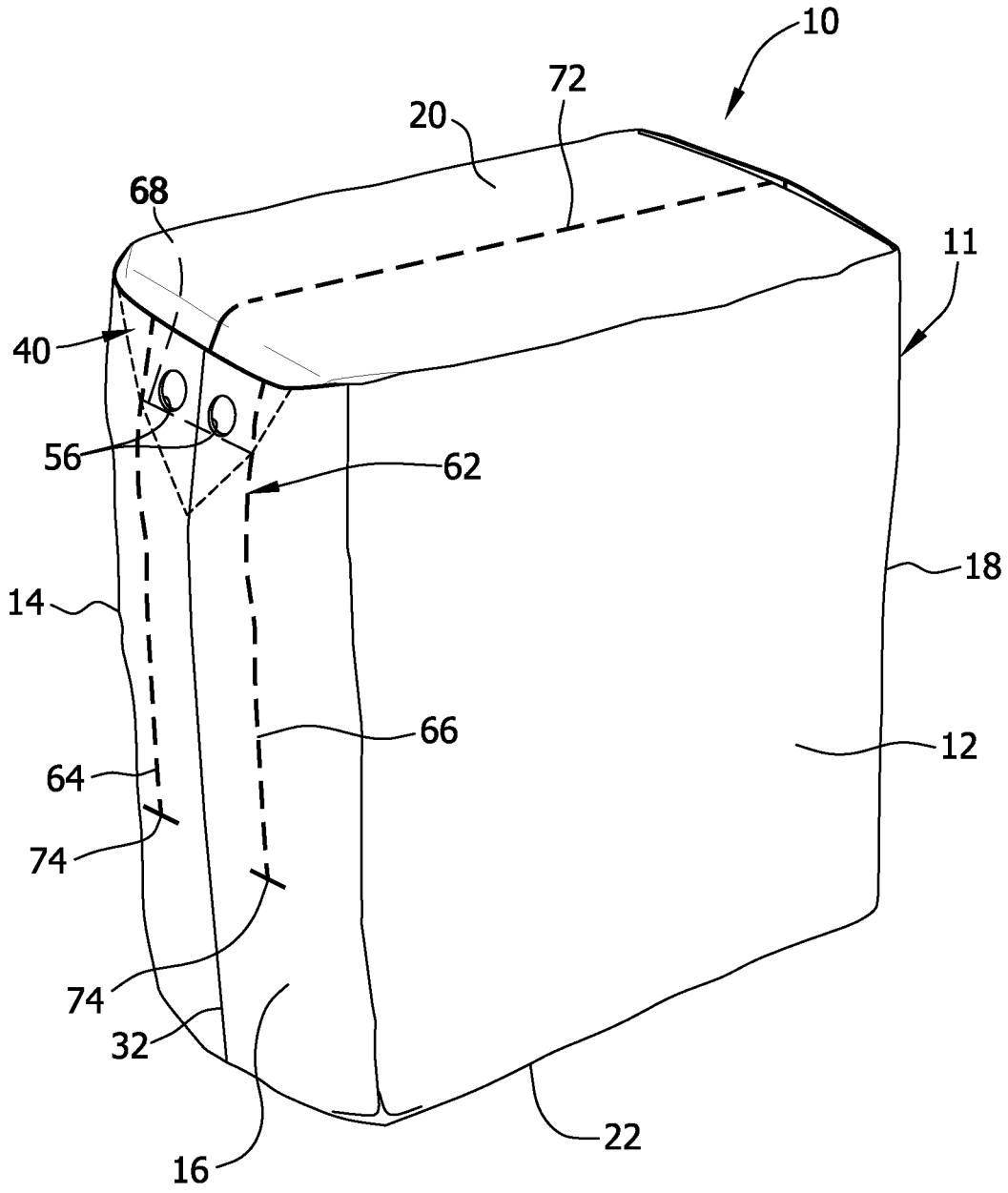
FIG. 11 is a perspective of the package wherein the first side panel of the packaging has still another embodiment of an opening feature disposed thereon.

FIG. 11 illustrates the package 10 of FIGS. 1-8 having stops 74 disposed adjacent the bottom of the first and second portions 64, 66 of the line of weakness 62. The stops 74 inhibit the packaging 11 from tearing beyond the extent of the first and second portions 64, 66 during opening of the package 10.

Figure 12:
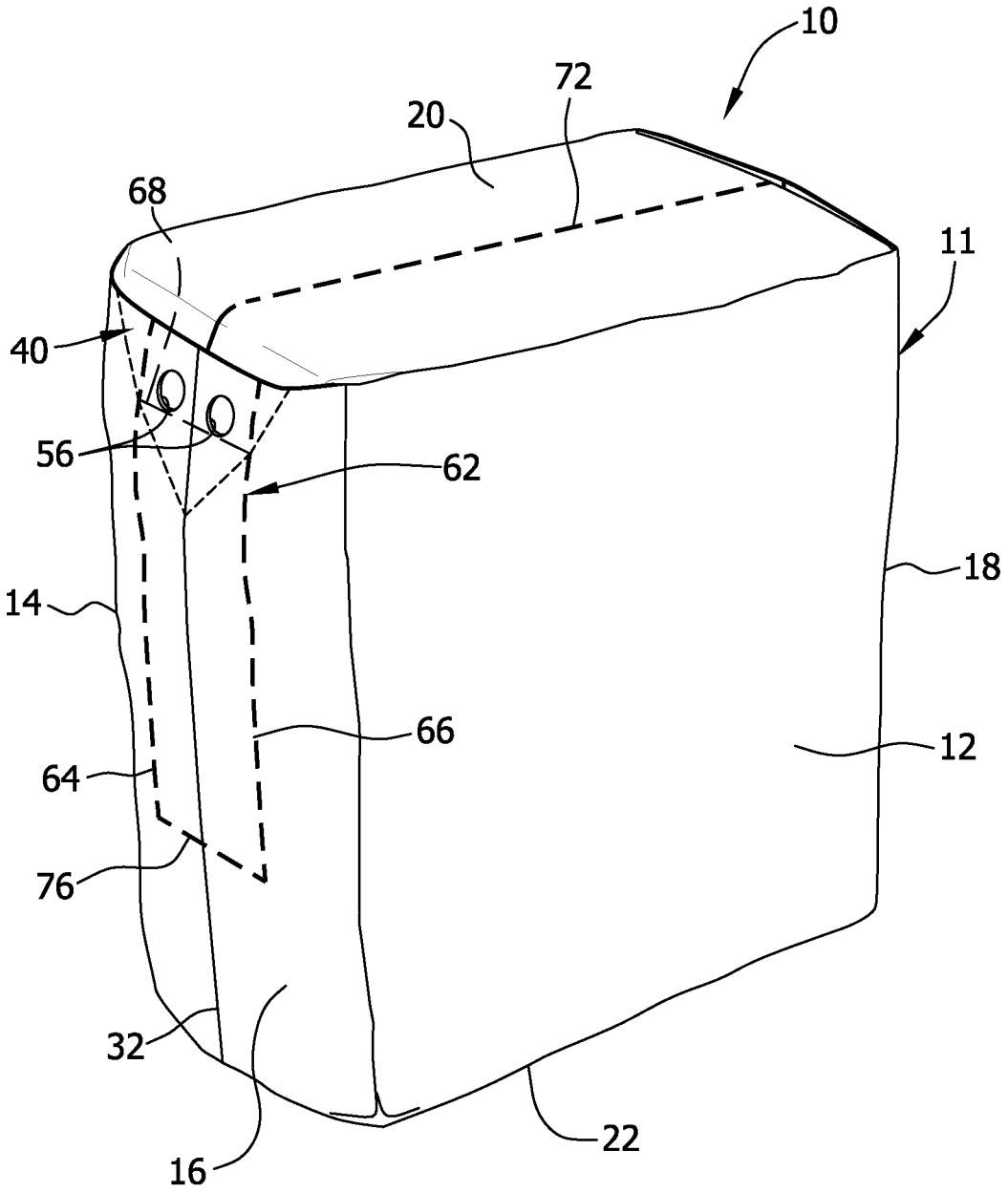
FIG. 12 is a perspective of the package wherein the first side panel of the packaging has a further embodiment of an opening feature disposed thereon.

FIG. 12 illustrates the package 10 of FIGS. 1-8 wherein the line of weakness 62 has a fourth portion 76 extending between the bottom of the first and second portions 64, 66. The fourth portion 76, which is torn when the opening feature 60 of the packaging 11 is used to open the package 10, facilitates the removal of the portion of the packaging that defines the opening 70. In other words, the portion of the packaging 11 within the first, second, third, and fourth portions 64, 66, 68, 74 of the line of weakness 62 is removed from the remainder of the packaging during opening of the package 10 via the opening feature 60.

Figure 13:
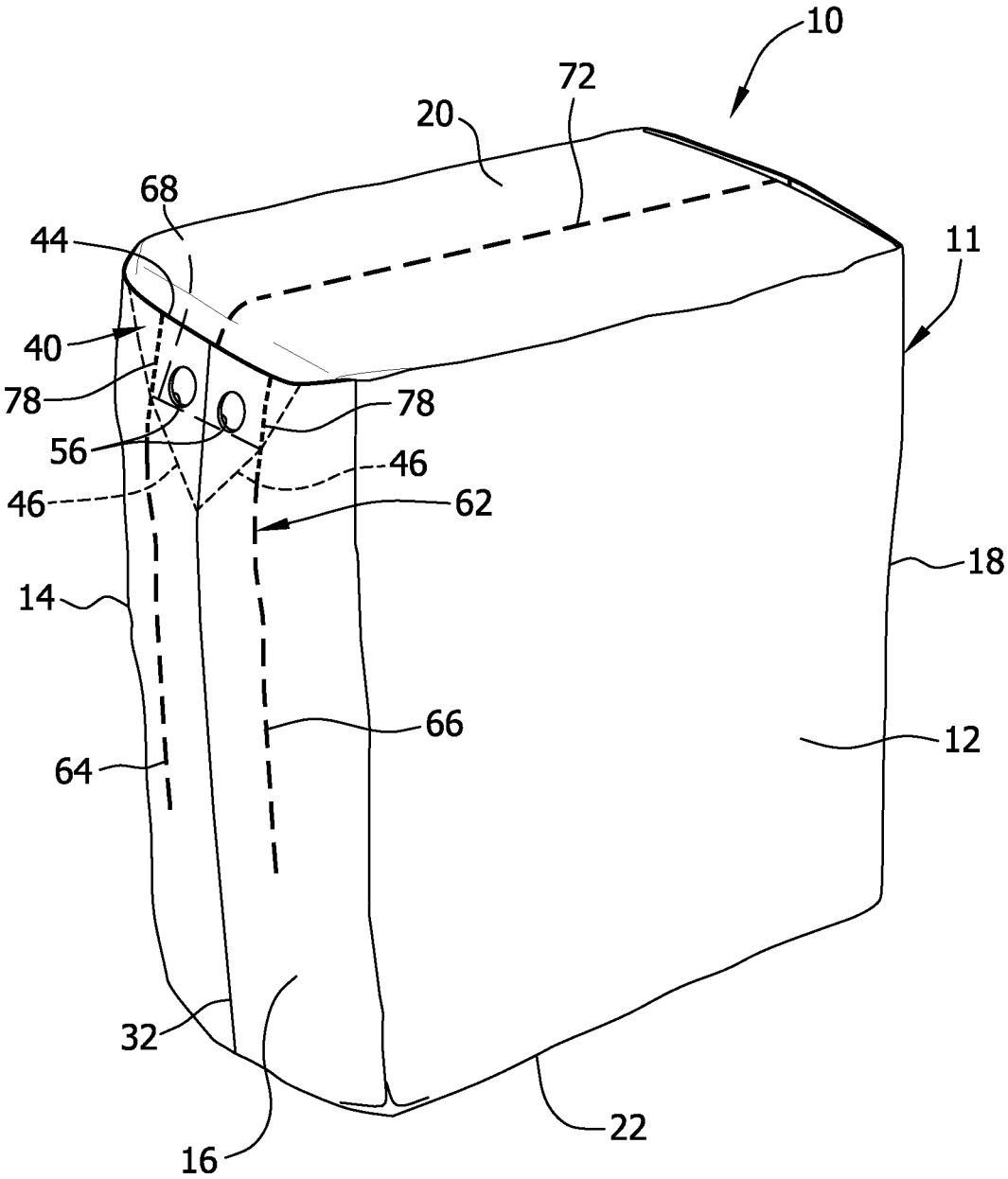
FIG. 13 is a perspective of the package wherein the first side panel of the packaging has still a further embodiment of an opening feature disposed thereon.

FIG. 13 illustrates the package 10 of FIGS. 1-8 wherein each of the first and second portions 64, 66 include a segment 78 that is more easily torn than the rest of the first and second portions 64, 66. In the illustrated embodiment, the segments 78 extend downward from the upper edge 44 of the gusset 40 and through each of the respective converging edges 46 of the gusset. It is contemplated, however, that the segments 78 can have any suitable extent. The illustrated segments 78 include a plurality of closely spaced perforation but it is understood that the segments can be formed in any suitable manner. Alternatively, the segment 78 can be a perforation that is longer than the perforations below it and provides a cut edge at the top of the gusset to better enable starting the tear.

In-Bag Force Test

An in-bag force test was conducted to measure the force acting on the packaging by the compressed absorbent articles. The test was first performed on a package containing 18 compressed incontinence underwear and then again on another package containing 20 compressed incontinence underwear. The products were arranged in a single row of 18 and 20 respectively between the side panels of the package. The size of the packaging and the specific type of incontinence underwear was the same in both tests. The package having 18 incontinence underwear had an in-bag force of about 9 pounds and the package having 20 incontinence underwear had an in-bag force of about 12 pounds.

The in-bag force of these two packages was determined using the following steps.

A package measuring device has a frame with sides to hold a moving crossbar to measure the package height or height of the stack of products. The bar has a width of 2⅛ inch and a length of 20¾ inch.

1. The package is centered under the crossbar of the package measuring device and the width of the package (i.e., the distance between the first and second side panels of the packaging) was measured to provide a compressed height of the stack of incontinence underwear.
2. The packaging was removed and the incontinence underwear maintained in their stacked arrangement thereby releasing the compression and allowing the stack of incontinence underwear to be become uncompressed.
3. The uncompressed stack of products is centered under the crossbar of the package measuring device and the height of the uncompressed stack of incontinence underwear was measured.
4. Weights were applied to the top of the bar over the uncompressed stack of incontinence underwear until the stack height measured the same as when it was in the packaging. The weight necessary to achieve the packaged height provides the in-bag force.

Packaging Opening Force (or Threshold force) Test

The packaging opening force (or threshold force) was measured to determine the peak pounds of force required to open the packaging using the opening feature. Testing was conducted on a conventional package (a package of Depend® incontinence underwear currently available from Kimberly-Clark Worldwide, Inc. having offices in Neenah, Wis., U.S.A.) and on several packages having the packaging with the opening feature described above with respect to FIGS. 1-8. The pounds of force required to open the conventional package was about 14 pounds. The pounds of force required to open the packages illustrated in FIGS. 1-8 was between about 7.5 pounds and about 9 pounds. The conventional package had perforations on the top panel of the package that extended into the inner panel of the gussets on the side panels of the package. Additionally, the conventional package had perforations across the top panel that extended into the front and back panels partway down the panels.

A suitable method for determining the packaging opening force is described using the following steps. It is understood, however, that an automated system such as an Instron testing apparatus can be used.

A chatillon force gauge Model DFIS100 available from Ametek, having offices in Largo, Fla. was equipped with a clamping fixture. The length of the clamp jaws was within 75 to 100 percent of the line of weakness to line of weakness spacing on the package being measured. The width of the clamp jaws was 18 mm×18 mm, 30 mm×18 mm, and 45 mm×18 mm. The clamp jaws were padded with a rubber gasketing material in order to securely hold the packaging material without damage.

Alternatively, when finger holes were tested, two hook-like pulling attachment with a spacing of 17 mm were used to simulate fingers used inside the finger apertures.

1. The package was placed upside down with the top panel towards a flat surface and held in place.
2. The clamp jaws of the chatillon force gauge were attached to the outer panel of the gusset of the opening feature of the packaging between the line of weakness spacing.
3. The chatillon force gauge was pulled upwards to initiate and propagate the tearing of the line of weakness of the opening feature.
4. The peak or maximum force required to tear the line of weakness of the opening feature of the packaging was recorded as the packaging opening force or threshold force.

Product Pull Out Test

A product pull out test was conducted to determine how much force is required to remove the first absorbent article from the packaging (e.g., the absorbent article disposed closest to the opening feature on the side panel compared to an absorbent article removed from the center of the packaging through an opening feature on the top panel of the packaging). The test was performed on packages containing 20 compressed incontinence underwear products. The pullout force for the first absorbent article closest to the opening feature on the side panel was 6.6 pounds, while removing an absorbent article from the center of the bag via an opening feature on the top panel required 11.8 pounds.

The product pull out test was conducted using the following steps. While a suitable method for manually determining the packaging pull out force is described using the following steps, it is understood that an automated system can be used, e.g., an Instron testing apparatus.

A chatillon force gauge Model DFIS100 available from Ametek, having offices in Largo, Fla. was equipped with a clamping fixture. The clamp dimension is an 18 mm circle. The clamping fixture is a seam test clamp, item #G201A22, available from SDL Atlas USA, having offices in Rock Hill, S.C.

1. The package was placed on a flat surface with the top panel of the packaging facing up.
2. The packaging was opened using the opening feature disposed on the first side panel for the side pull test. The package was opened using the line of weakness on the top panel of the bag for the center pull test. Different packages were used for each test.
2. The clamp fixture equipped on the chatillon force gauge was attached to the first absorbent article (i.e., the absorbent article disposed closest to the opening) for the side pull test. The clamp fixture was attached to an absorbent article in the center of the package for the center pull test.
3. While the package was being held firmly down, the absorbent article was removed from the packaging using the chatillon force gauge by pulling up on the gauge.
4. The peak (or maximum) force recorded by the chatillon force gauge was recorded.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "top", "bottom", "above", "below" and variations of these terms is made for convenience, and does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A package comprising:

a plurality of disposable absorbent articles; and a packaging having a front panel, a back panel, a top panel, a bottom panel, and a pair of side panels, the panels cooperatively defining an interior compartment of the packaging, at least one of the side panels having a longitudinal central axis, a pair of side edges, a gusset disposed adjacent the top panel, and a line of weakness having a first portion disposed on one side of the longitudinal central axis, a second portion disposed on the opposite side of the longitudinal central axis, and a transversely extending third portion spanning between and connecting the first and second portions, the third portion of the line of weakness being spaced from and longitudinally between the ends of the first and second portions, each of the portions of the line of weakness extending through the gusset, the gusset being arranged to form a pocket, the third portion of the line of weakness being disposed within the pocket, the plurality of disposable absorbent articles being compressed within the interior compartment of the packaging and arranged in at least one row extending between the side panels.

2. The package of claim 1 wherein the first and second portions of the line of weakness are generally parallel to each other and the longitudinal central axis of the at least one panel.

3. The package of claim 1 wherein the first and second portions of the line of weakness are nonparallel to each other and the longitudinal central axis of the least one panel.

4. The package of claim 3 wherein the first and second portions of the line of weakness are generally mirror images of each other.

5. The package of claim 1 wherein the first and second portions of the line of weakness are spaced outward from the longitudinal center axis by a distance greater than 3 millimeters.

6. The package of claim 1 wherein the at least one side panel of the packaging further comprises a seam, the seam being coaxial with the longitudinal central axis.

7. The package of claim 1 further comprising at least one finger aperture extending through the gusset, the third portion of the line of weakness being disposed below the finger aperture.

8. A package comprising:

a plurality of disposable absorbent articles; and a packaging having a front panel, a back panel, a top panel, a bottom panel, and a pair of side panels, the panels cooperatively defining an interior compartment of the packaging, at least one of the panels having an opening feature configured to move the package from a closed, sealed configuration to an opened configuration when at least a threshold force is applied to the opening feature, the plurality of disposable absorbent articles being compressed within the interior compartment of the packaging applying an in-bag force against the packaging and arranged in at least one row extending between the side panels, the threshold force being between about 1 pound and about 20 pounds and less than the in-bag force.

9. The package of claim 8 wherein the threshold force is between about 2 pounds and about 10 pounds.

10. The package of claim 9 wherein the threshold force is about 8 pounds.

11. The package of claim 8 wherein the in-bag force is between about 7 pounds and about 12 pounds.

12. The package of claim 11 wherein the in-bag force is about 9 pounds.

13. The package of claim 8 wherein the opening feature is disposed on one of the side panels.

14. The package of claim 8 wherein the plurality of disposable absorbent articles consists of one of a plurality of incontinence garments, a plurality of infant diapers, a plurality of training pants, a plurality of absorbent swim pants, a plurality of sanitary napkins, a plurality of pantyliners, and a plurality of feminine pads.

15. A package comprising:

a plurality of disposable absorbent articles; and a packaging having a front panel, a back panel, a top panel, a bottom panel, and a pair of side panels, the panels cooperatively defining an interior compartment of the packaging, the plurality of disposable absorbent articles being compressed within the interior compartment, at least one of the side panels having an opening feature including a gusset and a line of weakness that extends through and is operatively connected to the gusset, the gusset having an upper edge, an inner panel, and an outer panel, the inner and outer panels defining a pocket, the line of weakness comprising a first portion, a second portion, and a third portion that spans between and connects the first and second portions, the third portion of the line of weakness being located at least in part on the inner panel and spaced from the upper edge of the gusset, the gusset being generally triangular in shape and including the upper edge and two diagonal edges that extend downward from the upper edge and converge to a common point, the first and second portions of the line of weakness extending through the diagonal edges, the third portion of the line of weakness connecting to the first and second portions at the location where the first and second portions extend through the respective diagonal edge.

16. The package of claim 15 wherein the part of the third portion located on the inner panel of the gusset is spaced from the point of the gusset a distance equal to approximately 25 percent to 75 percent the distance from the point to the upper edge of the gusset.

17. The package of claim 16 wherein the part of the third portion located on the inner panel of the gusset is spaced from the point a distance equal to about 66 percent the distance from the point to the upper edge of the gusset.

18. The package of claim 15 wherein the gusset includes at least one finger aperture that extends through the outer panel of the gusset, the third portion of the line of weakness being disposed below the at least one finger aperture.

19. The package of claim 15 wherein the plurality of disposable absorbent articles consists of one of a plurality of incontinence garments, a plurality of infant diapers, a plurality of training pants, a plurality of absorbent swim pants, a plurality of sanitary napkins, a plurality of pantyliners, and a plurality of feminine pads.

20. The package of claim 15 wherein the top panel includes a longitudinally extending line of weakness.

* * * * *